United States Patent [19]

Miyagawa

[11] 4,292,021

[45] Sep. 29, 1981

[54] GAS LIGHTER

[75] Inventor: Yoshihisa Miyagawa, Sagamiharashi, Japan

[73] Assignee: Iwatani Sangyo Kabushiki Kaisha, Osaka, Japan

[21] Appl. No.: 119,097

[22] Filed: Feb. 6, 1980

[30] Foreign Application Priority Data

Nov. 2, 1979 [JP] Japan ..... 54-153030[U]

[51] Int. Cl.[3] ..... F21K 5/00

[52] U.S. Cl. ..... 431/13; 431/143; 431/255

[58] Field of Search ..... 431/132, 255, 13, 143

[56] References Cited

U.S. PATENT DOCUMENTS

| | | | |
|---|---|---|---|
| 2,957,328 | 10/1960 | Gellman | 431/13 |
| 3,161,034 | 12/1964 | Meyers | 431/254 |
| 3,436,164 | 4/1969 | Deucher | 431/255 |
| 3,895,905 | 7/1975 | Nissen | 431/254 |
| 4,190,034 | 2/1980 | Wonisch | 431/255 |

FOREIGN PATENT DOCUMENTS

| | | | |
|---|---|---|---|
| 2754639 | 1/1979 | Fed. Rep. of Germany | 431/255 |

*Primary Examiner*—Carroll B. Dority, Jr.
*Assistant Examiner*—Robert J. Marett
*Attorney, Agent, or Firm*—Schwartz, Jeffery, Schwaab, Mack, Blumenthal & Koch

[57] ABSTRACT

A gas lighter includes a fuel container, a trigger and a fuel control knob in the handle, and a piezoelectric switch operable by said trigger in the nozzle, said nozzle being prolonged sufficiently to keep the operator's hand at a safe distance from the gas flames taking place at the terminating end of said nozzle, said trigger being in engagement with a slidable lever, which is connected to a valve of said container at one end and is in engagement with said switch at the other end, said trigger and said knob being located in a range reachable by fingers of the same hand to grasp said handle with.

3 Claims, 3 Drawing Figures

GAS LIGHTER

BACKGROUND OF THE INVENTION

1. Field of the Invention

This invention relates to a gas lighter adapted for use in a kitchen to ignite a gas cooker. More particularly, this invention relates to a gas lighter including a fuel container, a trigger and a fuel control knob in the handle portion, and a piezoelectric switch in the nozzle portion, wherein the nozzle portion is prolonged sufficiently to keep the operator's hand at a safe distance from the ignition point provided at its terminating end, and wherein the switch is located at an effectively shortened distance from the ignition point, thereby maintaining a constant ignition efficacy regardless of the prolonged nozzle.

2. Description of the Prior Art

A gas lighter for such use is known and in wide use, but in known gas lighters their piezoelectric switch is located in the handle. In order to keep the operator's hand at a safe distance from the gas flames, it is required to provide a relatively long nozzle, which necessarily requires that the lead line is long enough to reach from the switch to the ignition point at the nozzle end. However, voltage is likely to drop during transmission along the long lead line, thereby resulting in the unstable ignition efficacy. In addition, the known gas lighters have their handle internally packed with many components including the triggering and piezoelectric elements, and consequently the handle portion must have a complicated internal structure.

The present invention is directed toward solving the problem pointed out above, and has for its object to provide an improved gas lighter having a piezoelectric switch located in the nozzle portion to shorten the distance between the switch and the ignition point.

Another object of the present invention is to provide an improved gas lighter capable of initiating the ignition and, if desired, controlling the amount of fuel by fingers of the same hand to grasp the handle with.

A further object of the present invention is to provide an improved gas lighter which allows the fuel to be effectively used up with a constantly stable ignition efficacy.

A still further object of the present invention is to provide an improved gas lighter having a trigger which can be readily worked by a thumb's force naturally acting when the operator stretches his arm toward the burner ring of a gas cooker.

Other objects and advantages will become apparent from the following description and accompanying drawings.

SUMMARY OF THE INVENTION

According to the present invention, a gas lighter includes a handle portion and a nozzle portion which is prolonged enough to keep the operator's hand at a safe distance from the gas flames, the handle portion including a fuel container and a trigger, and the nozzle portion including a piezoelectric switch operable by said trigger, the piezoelectric switch being located at an effectively shortened distance from the ignition point, the trigger being associated with a lever capable of twofold operations in its single movement for triggering said switch and opening a valve to said fuel container to initiate the supply of fuel to the ignition point, the handle portion further including a fuel control knob workable by a finger, the knob being connected to said valve to cause the same to regulate the amount of fuel flow.

DETAILED DESCRIPTION OF THE INVENTION

Figure 1:
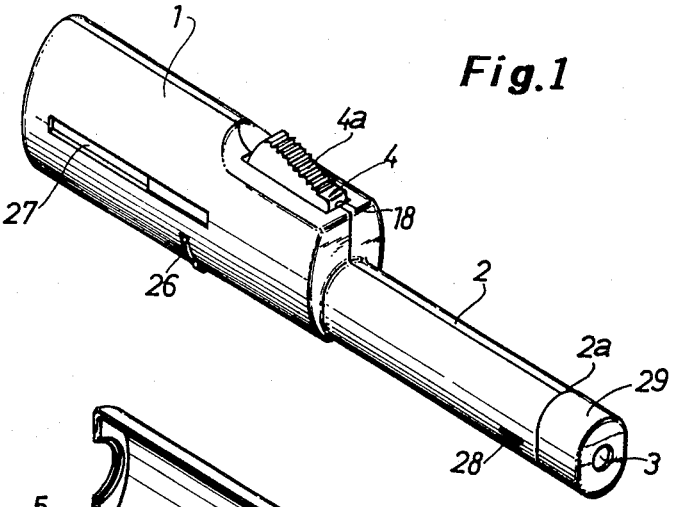
FIG. 1 is a perspective view showing a gas lighter embodying the present invention.
Figure 2:
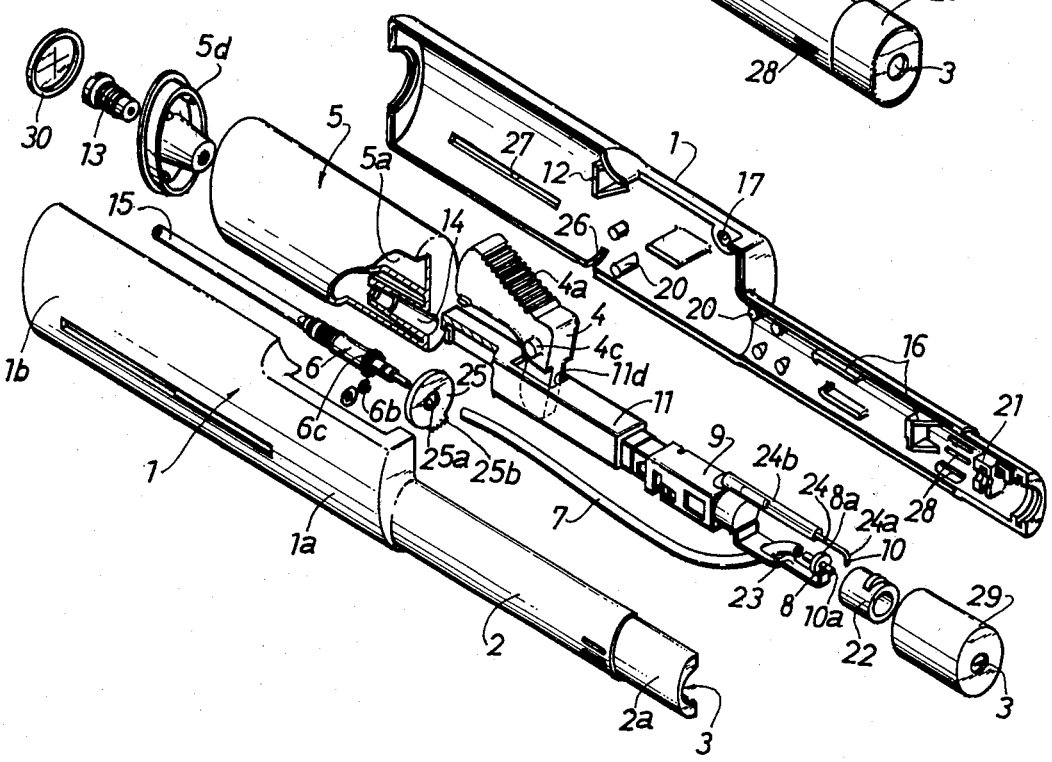
FIG. 2 is a perspective analytical view particularly showing components included in the gas lighter in FIG. 1.

As shown in FIG. 1, the gas lighter of the present invention is externally made up of a shank or handle 1, a cylindrical nozzle 2 extended from a lower portion of the handle, and a trigger 4 projecting in the top surface of the handle. The handle 1 and nozzle 2 are made in one body of plastic moldings, wherein each half shell is separately molded and bonded to the other.

For explanation's sake, the handle 1 is divided into a front section **1*a* and a rear section 1*b*, wherein the rear section includes a selfcontained liquefied gas container 5 which is connected to a pipe 7 through a valve 6. The pipe 7 extends to the terminating end 2*a* of the nozzle, where ignition takes place, and is provided with an ignition tip 8 at its terminating end, which functions as a positive ignition terminal 10*a*. Opposed to this positive ignition terminal, there is provided a negative ignition terminal 10, which is connected to a piezoelectric switch 9. The trigger 4 is engaged with a slidable lever 11 adapted to open and close the valve 6 and also to turn on the switch 9 in its single movement. In this way, when the trigger 4 is oppressed by an operator's thumb, the lever 11 opens the valve 6 to initiate the supply of fuel, and simultaneously turns on the switch 9, thereby effecting the ignition of the fuel at the terminating end 2*a*** of the nozzle.

The container 5 is fastened in the handle 1 by means of a bracket 12, and is internally divided into an upper section **5*b* and a lower section 5*c* by a horizontally extended partition 5*a*, wherein these two sections communicate with each other at the tail portion of the container. The container 5 is closed by a plug 5*d* having a detachable injection valve 13**.

Figure 3:
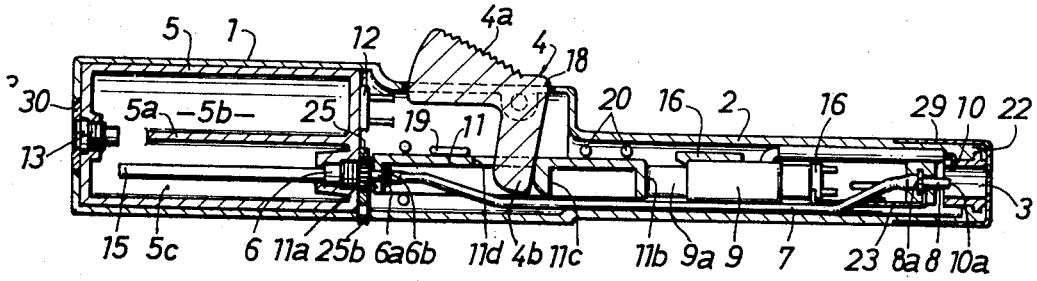
FIG. 3 is a longitudinal cross-section.

The lower section **5*c* of the container has a relatively thick wall in the opposite side to its tail portion, and through this thick wall a bore 14 is produced to accept the valve 6. The valve 6 is connected to a pipe 15 which extends within the lower section 5*c*. So long as the container contains fuel, the lower section 5*c* is normally filled with the fuel, thereby enabling the pipe 15 to become submerged in the fuel. The pipe 15 is provided with an fuel inlet port to secure the supply of fuel to the pipe 7 via the valve 6. The valve 6 has a top end 6*a* in which a ring-shaped flange 6*b* is provided to make engagement with the left-hand end face 11*a* of the lever 11, thereby securing a unitary movement of the valve and lever. When the lever is moved to the right, the valve is likewise moved to the right, thereby allowing the fuel to let out into the pipe 7. The right-hand end face 11*b* of the lever is engaged with the input 9*a* of the switch 9, which is fastened to the nozzle 2 by means of a bracket 16. The lever 11 is normally biased to the left, that is, toward the valve 6 by means of a spring (not shown) housed in the switch, which means that the gas lighter is in the inoperative state unless the trigger is worked. It is arranged that the stroke of the valve 6 is shorter than that of the switch 9, and accordingly there is provided a slight allowance between the left-hand end 11***a* of the lever and the flange 6*b* on the valve 6 as shown in FIG. 3.

The trigger 4 takes the form of letter L with a longer leg 4*a* and a shorter leg 4*b*, and has a pair of pins 4*c* fastened thereto, the pins being rotatably carried on the handle. To accept the pins 4*c* accommodation holes 17 are provided in each half shell. The longer leg 4*a* projects outside through an opening 18 produced in the handle, and the shorter leg 4*b* extends downward into the nozzle, wherein the terminating end of the shorter leg is insertedly held in an opening 11 in the lever 11 to effect their associated movement. In FIG. 3, when the trigger 4 is oppressed by a thumb, the shorter leg 4*b* tends to rotate in the counterclockwise direction, thereby causing the lever 11 as a whole to move to the right against the spring (not shown) provided in the switch 9. The opening 18 has a sufficient size to allow the shorter leg 4*b* to swing about the pin 4*c*. The lever 11 is prevented from displacing upward or downward by means of a guide plate 19 and guide pins 20, both being projectingly provided on the inside wall of the handle 1, whereby the lever 11 is only allowed to move along the length of the nozzle 2.

The pipe 7 is preferably made of a resilient material, and as is evident from the foregoing, extends from the top end 6*a* of the valve up to the ignition tip 8 of the nozzle. As shown in FIG. 3, it is preferred that the pipe 7 is laid under the lever 11 and switch 9. The ignition tip 8*a* is insertedly supported by a supporter 21 provided on the inside wall of the nozzle 2, such that the same is directed toward a muzzle 3, wherein a cylindrical frame guide 22 of heat-proof material is provided between the muzzle 3 and the ignition tip 8*a*.

As described above, the positive and negative ignition terminals 10*a* and 10 are opposedly located in the firing section, and this construction will be more particularly explained:

The positive ignition terminal 10*a* is made up of a metal sheet 23, which is connected to the positive electrode of the switch 9 at one end while being connected to the base portion of the ignition tip 8 at the other end. In this case, it is preferred that a ring-shaped connector 8*a* is employed to secure the end of the metal sheet 23 as shown in FIG. 3. The negative ignition terminal 10 is made up of a lead line 24 connected to the negative electrode of the switch 9, wherein the lead line 24 is preferably covered firstly with an insulating pipe 24*a*, for example, of "Tefron", and secondly with a vinyl tube 24*b*. The terminating end of the lead line 24 is bended toward the ignition tip 8*a* of the nozzle.

The trigger 4 is provided with dentures on its longer leg 4*a* to secure a finger touch thereto. When the trigger 4 is oppressed, the lever 11 is caused to move to the right in FIG. 3. In association of the rightward movement of the lever 11 the valve 6 is opened, thereby allowing the gasified fuel therein to flow to the ignition tip 8 through the resilient pipe 7. Simultaneously, the piezoelectric switch 9 is switched on, thereby effecting electric discharge between the ignition terminals 10 and 10*a*. In this way the spark ignites the fuel blown through the ignition tip 8. After the fuel has been ignited, the trigger 4 is released from the finger oppression, thereby causing the lever 11 to return to its original position under the action of the spring (not shown) in the switch 9.

The valve 6 is provided with a pinion 6*c* on which a wheel 25 is fitted such that the inner threads 25*a* of the wheel engage with the pinion 6*c* to secure their associated rotation, wherein the wheel includes a knob 25*b* which projects outside through a slot 26 produced in the handle 1 as shown in FIG. 1. The size of the slot 26 is large enough to allow the knob 25*b* to move to and fro in a semi-circle, during which the valve 6 is controlled, thereby regulating the supplying amount of gas to the pipe 7.

It is preferred that the container 5 is made of a transparent or semitransparent plastics to enable a possible deficiency of the content to be watched from the outside. To achieve it the illustrated embodiment has a slit 27 in the handle through which the content is seen.

The nozzle 2 is provided with an air intake port 28 at its end portion, and with a metal cap 29 at its terminating end to protect the nozzle against the gas flames.

For assembling the gas lighter, each component mentioned above is fastened in place on each half shell, without the use of screws or an adhesive agent. Then the half shells are bonded to each other. Finally the metal cap 29 is capped on the end of the nozzle 2 and a lid 30 is fitted at the tail portion of the handle 1 to cover the injection valve 13.

What is claimed is:

1. A gas lighter adapted for use in a kitchen, said gas lighter comprising:

a handle portion;

a nozzle portion having an ignition point at its terminating end;

said handle portion including a fuel container, a trigger workable by a finger touch and a fuel control knob;

said nozzle portion being prolonged sufficiently to keep the operator's hand at a safe distance from the gas flames;

said nozzle portion including a piezoelectric switch electrically connected to said ignition point, and located at an effectively shortened distance therefrom;

a fuel supplying pipe connecting said fuel container to said ignition point with a valve interlocated therebetween;

said trigger being rotatably carried on said handle portion, and being in engagement with a spring-loaded lever slidable along the length of said nozzle portion, wherein said lever is connected to said valve at one end to secure their associated movement while being in engagement with said switch at the other end;

said lever being normally biased under spring load to the inoperative state of the gas lighter, and said fuel control knob being located in a range reached by a finger of the hand to grasp said handle portion with.

2. A gas lighter as set forth in claim 1, wherein the fuel container is internally divided into an upper section and a lower section by means of a horizontally extended partition, said upper and lower sections communicating with each other, and wherein the valve is located in said lower section.

3. A gas lighter as set forth in claim 1, wherein the fuel container is made of transparent or semitransparent material to enable the operator to watch a possible deficiency of the fuel, and wherein the handle portion is provided with a slit correspondingly located to said fuel container.

* * * * *